US011103114B2

(12) United States Patent
Peng et al.

(10) Patent No.: US 11,103,114 B2
(45) Date of Patent: Aug. 31, 2021

(54) GROUND BRUSH FOR CLEANING APPLIANCE AND CLEANING APPLIANCE

(71) Applicant: MIDEA GROUP CO., LTD., Foshan (CN)

(72) Inventors: Xiaokang Peng, Foshan (CN); Siyu Jin, Foshan (CN); Zhonghua Li, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 356 days.

(21) Appl. No.: 16/233,133

(22) Filed: Dec. 27, 2018

(65) Prior Publication Data

US 2019/0125150 A1 May 2, 2019

Related U.S. Application Data

(63) Continuation of application No. PCT/CN2016/104125, filed on Oct. 31, 2016.

(30) Foreign Application Priority Data

Aug. 15, 2016 (CN) ..... 201610669310.1
Aug. 15, 2016 (CN) ..... 201620883805.X

(51) Int. Cl.
*A47L 9/06* (2006.01)
*A47L 9/02* (2006.01)
*A47L 5/28* (2006.01)

(52) U.S. Cl.
CPC ..... *A47L 9/0686* (2013.01); *A47L 9/02* (2013.01); *A47L 9/0613* (2013.01); *A47L 5/28* (2013.01)

(58) Field of Classification Search
CPC ..... A47L 5/30; A47L 9/0477; A47L 9/0411; A47L 9/04; A47L 5/34; A47L 9/0686;
(Continued)

(56) References Cited

U.S. PATENT DOCUMENTS 4,638,526 A * 1/1987 Murata ..... A47L 9/06 15/367
6,009,594 A * 1/2000 Grey ..... A47L 11/30 15/322

(Continued)

FOREIGN PATENT DOCUMENTS

CN 1113137 A 12/1995
CN 1939200 A 4/2007

(Continued)

OTHER PUBLICATIONS

The third Office Action dated Aug. 5, 2019 in the corresponding CN application No. 201610669310.1.

(Continued)

*Primary Examiner* — Robert J Scruggs

(57) ABSTRACT

A ground brush for a cleaning appliance and a cleaning appliance with the same are provided. The ground brush includes: a body and a front dust collection strip. The body defines an air channel therein, a bottom plate of the body defines a suction port in communication with the air channel, and a rear side of the body defines an exhaust port. When the body covers a surface to be cleaned, an airtight space is defined between the air channel and the surface to be cleaned. The front dust collection strip is arranged at a front end of the body to support the ground brush for a cleaning appliance on the surface to be cleaned, defines a plurality of front air inlets in communication with the air channel, and is incline relative to a normal direction of the surface to be cleaned.

17 Claims, 4 Drawing Sheets

(58) Field of Classification Search
CPC . A47L 9/02; A47L 9/0613; A47L 5/28; A47L 9/06
See application file for complete search history.

(56) References Cited

U.S. PATENT DOCUMENTS

| | | | | |
|---|---|---|---|---|
| 6,101,668 | A * | 8/2000 | Grey | A47L 7/0009 15/322 |
| 8,424,157 | B2 * | 4/2013 | Gell | A47L 9/02 15/415.1 |
| 2002/0079761 | A1 | 6/2002 | Hiroshi | |
| 2008/0295270 | A1 * | 12/2008 | Lee | A47L 9/0666 15/184 |
| 2013/0174374 | A1 * | 7/2013 | Guder | A47L 9/02 15/415.1 |
| 2016/0113458 | A1 | 4/2016 | Wook | |

FOREIGN PATENT DOCUMENTS

| | | | |
|---|---|---|---|
| CN | 101313830 | A | 12/2008 |
| CN | 201899445 | U | 7/2011 |
| CN | 203564182 | U | 4/2014 |
| CN | 103767621 | A | 5/2014 |
| CN | 104138239 | A | 11/2014 |
| CN | 205054020 | U | 3/2016 |
| CN | 205411083 | U | 8/2016 |
| EP | 0885586 | A1 | 12/1998 |
| GB | 2140673 | A | 12/1984 |
| WO | 02026098 | A1 | 4/2002 |

OTHER PUBLICATIONS

International Search Report dated May 10, 2017 in the corresponding PCT application (application No. PCT/CN2016/104125).
CN 2nd Office Action dated Feb. 11, 2019 in the corresponding CN application (application No. 201610669310.1).
OA for EP application 16913370.9.
OA for CN application 201610669310.1.

* cited by examiner

GROUND BRUSH FOR CLEANING APPLIANCE AND CLEANING APPLIANCE

CROSS-REFERENCE TO RELATED APPLICATION

This application is a continuation of International Application No. PCT/CN2016/104125, filed on Oct. 31, 2016, which claims priority to and benefits of Chinese Patent Application Serial No. 201610669310.1 and 201620883805.X, filed with China National Intellectual Property Administration on Aug. 15, 2016, the entire content of which is incorporated herein by reference.

FIELD

The present disclosure relates to a field of household appliances, and more particularly to a ground brush for a cleaning appliance and a cleaning appliance.

BACKGROUND

In the related art, a cleaning appliance such as a vacuum cleaner is a household appliance that can generate negative pressure to suck dirt such as dusts and hairs, achieving cleaning effect. The performance of the vacuum cleaner mainly depends on two factors, i.e. dust cleaning ability and noise which are closely related to an air channel in a ground brush. The dust cleaning ability depends on suction generated by a main part of the cleaning appliance on one aspect. However, on the premise of a definite main part, a structure (such as an active area of an air inlet of the ground brush, a gap between the ground and the ground brush and the like) of the air channel of the ground brush determines distribution of velocity of an air flow when the air flow enters the ground brush and distribution of pressure in the ground brush, and then the dust cleaning effect is affected. Noise of the cleaning appliance mainly comes from the main part and the ground brush. The noise from the main part is generated by an internal motor operating at a high speed and mechanical vibration. The noise from the ground brush is mainly air-operated noise generated by an air flow flowing at a high speed, which is directly affected by the air channel of the ground brush.

However, dust cleaning ability and noise are a pair of contradictories. It's needed to increase the velocity of an air flow when the air flow enters the ground brush in order to improve the dust cleaning ability, while air-operated noise generally becomes louder along with the increase of the velocity. The air-operated noise becomes lower along with the reduction of the velocity, however, the dust cleaning ability becomes poor at the same time.

SUMMARY

The present disclosure seeks to solve at least one of the problems existing in the related art to at least some extent. An objective of the present disclosure is to provide a ground brush for a cleaning appliance. The ground brush for a cleaning appliance is good at dust cleaning ability, low in noise, simple in structure and low in cost.

Another objective of the present disclosure is to provide a cleaning appliance with the above ground brush.

The ground brush for a cleaning appliance according to embodiments of the present disclosure includes: a body defining an air channel therein, the body including a bottom plate defining a suction port in communication with the air channel and a rear side defining an exhaust port, and when the body covers a surface to be cleaned, an airtight space is defined between the air channel and the surface to be cleaned; and a front dust collection strip arranged at a front end of the body to support the ground brush for a cleaning appliance on the surface to be cleaned, defining a plurality of front air inlets in communication with the air channel, and being inclined relative to a normal direction of the surface to be cleaned.

With the ground brush for a cleaning appliance, the front dust collection strip is obliquely arranged relative to the normal direction of the surface to be cleaned, the air channel of the ground brush for a cleaning appliance is optimized, the flowing condition of the air flow in the ground brush for a cleaning appliance is improved, and the dust cleaning ability of the ground brush for a cleaning appliance can be effectively improved and the noise from the ground brush for a cleaning appliance can reduced. In addition, compared with a traditional noise reduction solution, in which a ground brush for a cleaning appliance is provided with a roller and a fan therein, or a body defines a noise reduction cavity filled with sound absorption medium, the ground brush for a cleaning appliance is simple in structure and low in cost.

In addition, the ground brush for a cleaning appliance according to the present disclosure further has the following additional features.

According to some embodiments, an angle $\alpha$ between the front dust collection strip and the normal direction of the surface to be cleaned satisfies that $\alpha$ is greater than or equal to 30° and less than or equal to 60°.

In one embodiment, the angle $\alpha$ between the front dust collection strip and the normal direction of the surface to be cleaned satisfies that $\alpha$ is equal to 45°.

According to some embodiments, a distance between an upper end of a front air inlet and the bottom plate satisfies that a is greater than or equal to 3 mm.

According to some embodiments, the plurality of front air inlets are symmetrically arranged about a central plane of symmetry of the body, and distances between adjacent front air inlets are different.

In one embodiment, the distances between adjacent front air inlets gradually reduce towards a direction of the central plane of symmetry.

According to some embodiments, a sum S1 of areas of the plurality of front air inlets satisfies that S1 is greater than or equal to 200 mm2 and less than or equal to and less than or equal to 400 mm2.

Furthermore, at least one side of the body defines a side air inlet in communication with the air channel.

In one embodiment, a height of the side air inlet is less than a height of a front air inlet, and a depth d of the side air inlet satisfies that d is greater than or equal to 5 mm.

In one embodiment, a sum S2 of area of the side air inlet satisfies that S2 is greater than or equal to 100 mm2 and less than or equal to 300 mm2.

In one embodiment, a sum S1 of areas of the plurality of front air inlets and the sum S2 of the area of the side air inlet satisfy that a sum of S1 and S2 is greater than or equal to 300 mm2 and less than or equal to 500 mm2.

According to some embodiments, the air channel includes: a front wall, a distance between the front wall and the surface to be cleaned gradually increasing in a direction from front to rear and from two sides to middle, the exhaust port being defined in the front wall; a rear wall, a cross section of the rear wall being an arc section, a smooth transition being provided between an upper end of the rear wall and the front wall, the exhaust port being defined in the rear wall, and a smooth transition being provided between the exhaust port and the rear wall; two side walls connected to two sides of the front wall and the rear wall, respectively; and a lower wall connected to the exhaust port, having an arc surface, and an angle β between a tangent at any point, which is projected by the lower wall, on a central plane of symmetry of the body and the surface to be cleaned satisfies that β is less than or equal to 45°.

In one embodiment, a height h of the side walls satisfies that h is less than or equal to 3 mm.

According to some embodiments, a radius D of an arc surface of an arc transition between the rear wall and the exhaust port satisfies that D is greater than or equal to 25 mm.

According to some embodiments, a cross section of the exhaust port is in the shape of an ellipse, a long axis of the ellipse is parallel to the bottom plate, and a short axis of the ellipse is perpendicular to the bottom plate.

According to some other embodiments, a cross section of the exhaust port is in the shape of a circle or a polygon with more than four edges.

A cleaning appliance according to an embodiment of the present disclosure includes: an appliance body; and a ground brush according to embodiments of the present disclosure, and the ground brush is in communication with the appliance body by means of a connecting tube.

The cleaning appliance according to embodiments of the present disclosure includes the ground brush for a cleaning appliance according to the first aspect of the present disclosure, the dust cleaning ability of the cleaning appliance is improved, and the noise of the cleaning appliance is reduced, the structure of the cleaning appliance is simplified and the cost of the cleaning appliance is lowered.

Embodiments of present disclosure will be given in part in the following descriptions, become apparent in part from the following descriptions, or be learned from the practice of the embodiments of the present disclosure.

BRIEF DESCRIPTION OF THE DRAWINGS

Embodiments of the present disclosure will become apparent and more readily appreciated from the following descriptions made with reference to the drawings, in which.

REFERENCE NUMERALS

Figure 1:
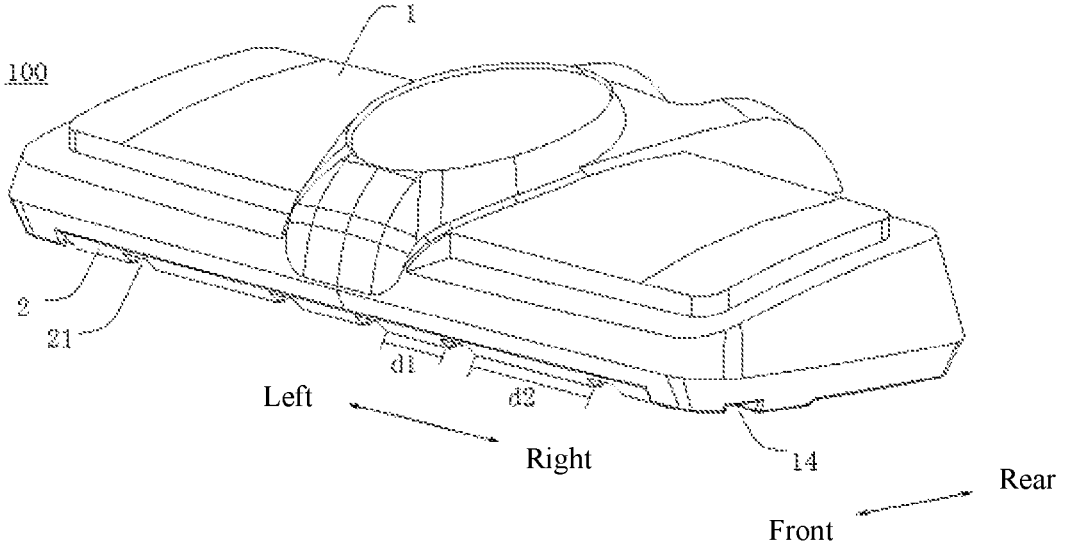
FIG. 1 is a schematic view of a ground brush for a cleaning appliance according to an embodiment of the present disclosure.

Ground brush 100 for a cleaning appliance, body 1, air channel 11, front wall 111, rear wall 112, side wall 113, lower wall 114, bottom plate 12, exhaust port 13, side air inlet 14, front dust collection strip 2, front air inlet 21, rear dust collection strip 3.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the description of the present disclosure, it should be understood that, terms such as "central", "upper", "lower", "front", "rear", "left", "right", "vertical", "horizontal", "top", "bottom", "inner", and "outer" should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure.

It should be understood that, terms such as "first" and "second" are used herein for purposes of description and are not intended to indicate or imply relative importance or significance. Thus, the feature defined with "first" and "second" may comprise one or more of this feature. In the description of the present invention, the term "a plurality of" means two or more than two, unless specified otherwise.

A ground brush 100 for a cleaning appliance according to an embodiment of the present disclosure is described with reference to FIG. 1 to FIG. 4. The ground brush 100 for a cleaning appliance can be applied to a cleaning appliance, such as a vacuum cleaner and the like.

Figure 2:
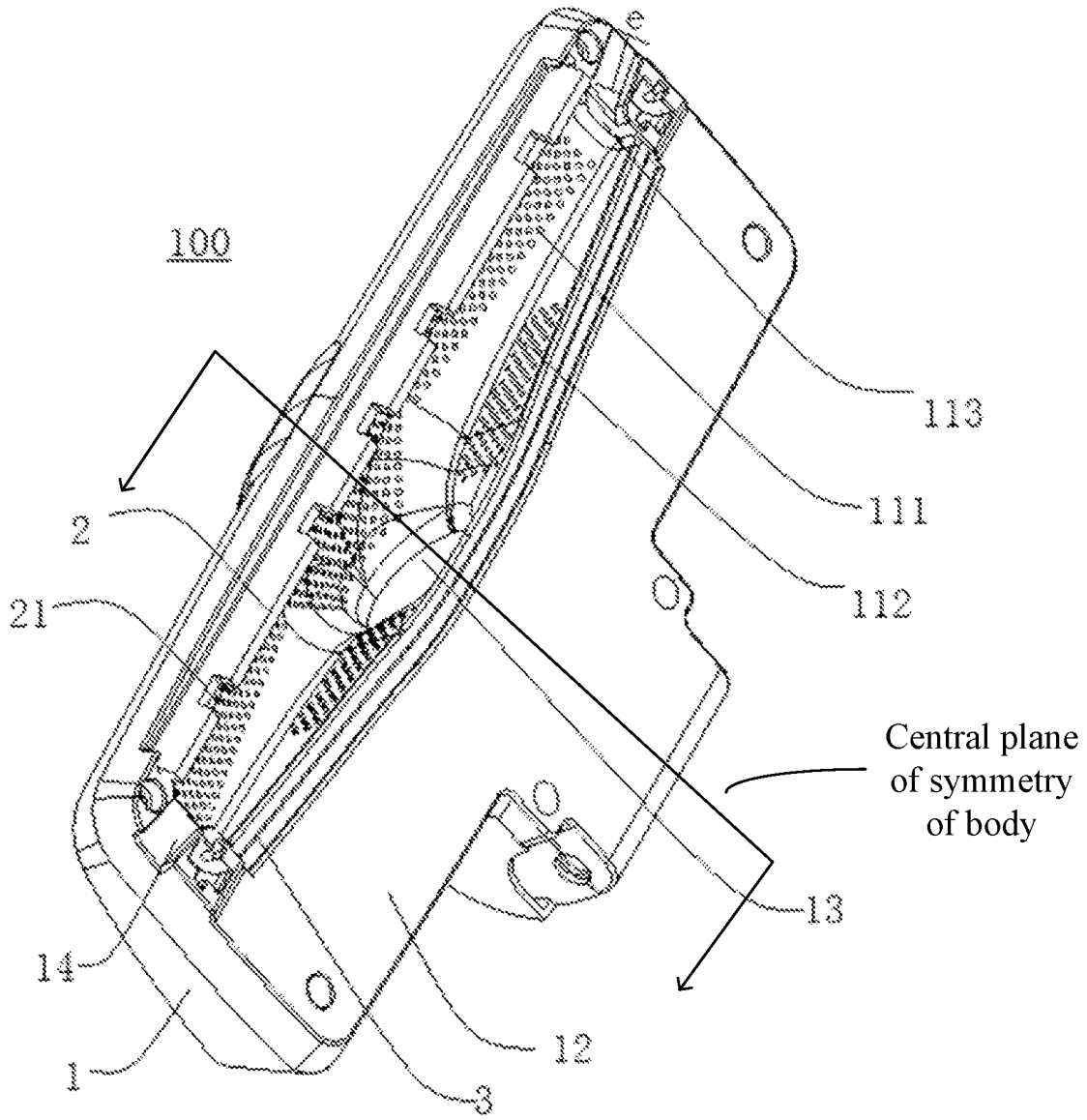
FIG. 2 is another schematic view of the ground brush for a cleaning appliance shown in FIG. 1.

As shown in FIG. 1 and FIG. 2, the ground brush 100 for a cleaning appliance according to an embodiment of the present disclosure includes a body 1 and a front dust collection strip 2.

In one embodiment, the body 1 defines an air channel 11 therein, a bottom plate 12 of the body 1 defines a suction port in communication with the air channel 11, and a rear side of the body 1 defines an exhaust port 13. When the body 1 covers a surface, such as a carpet, a floor and a sofa, etc., to be cleaned, an airtight space is defined between the air channel 11 and the surface to be cleaned. The exhaust port 13 is connected to a connecting tube (not shown), such as a hose, so as to deliver dust on the surface to be cleaned into a dust collection part, such as a dust cup, in a cleaning appliance.

The front dust collection strip 2 is arranged at a front end of the body 1 to support the ground brush 100 for a cleaning appliance on the surface to be cleaned, and the front dust collection strip also separates the air channel 11 and the surface to be cleaned. The front dust collection strip 2 defines a plurality of, such as six, eight, etc., front air inlets 21 in communication with the air channel 11. The front dust collection strip 2 is inclined relative to a normal direction of the surface to be cleaned. Air flow enters the ground brush 100 for a cleaning appliance through the front air inlets 21. The air flow is effectively accelerated when passing through the front air inlets 21, such that an object to be cleaned can be conveniently sucked into the air channel 11.

It should be noted herein, in the description, the term "a plurality of" means two or more than two, unless specified otherwise. In addition, "normal of the surface to be cleaned" means a line which is perpendicular to the surface to be cleaned.

The front dust collection strip 2 may be inclined towards a direction near to a center of the ground brush 100 for a cleaning appliance, relative to a normal direction of the surface to be cleaned, or may be inclined against a direction away from the center of the ground brush 100 for a cleaning appliance, relative to the normal direction of the surface to be cleaned.

Figure 3:
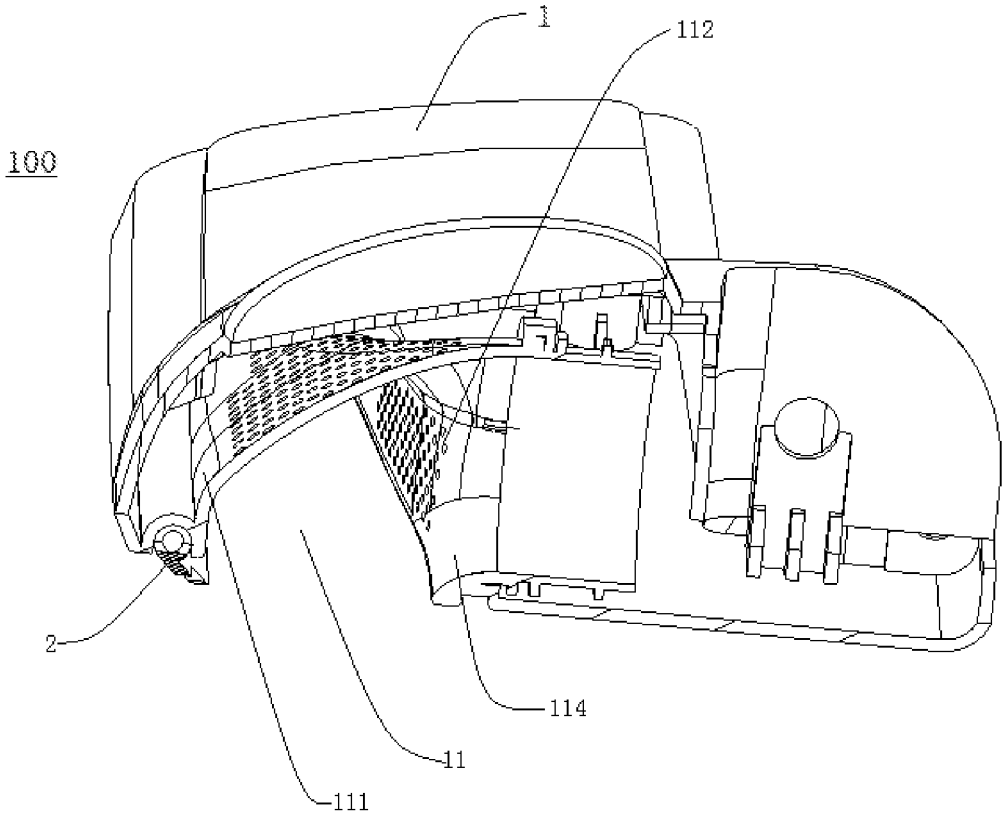
FIG. 3 is a partially sectional view of a ground brush for a cleaning appliance according to an embodiment of the present disclosure.
Figure 4:
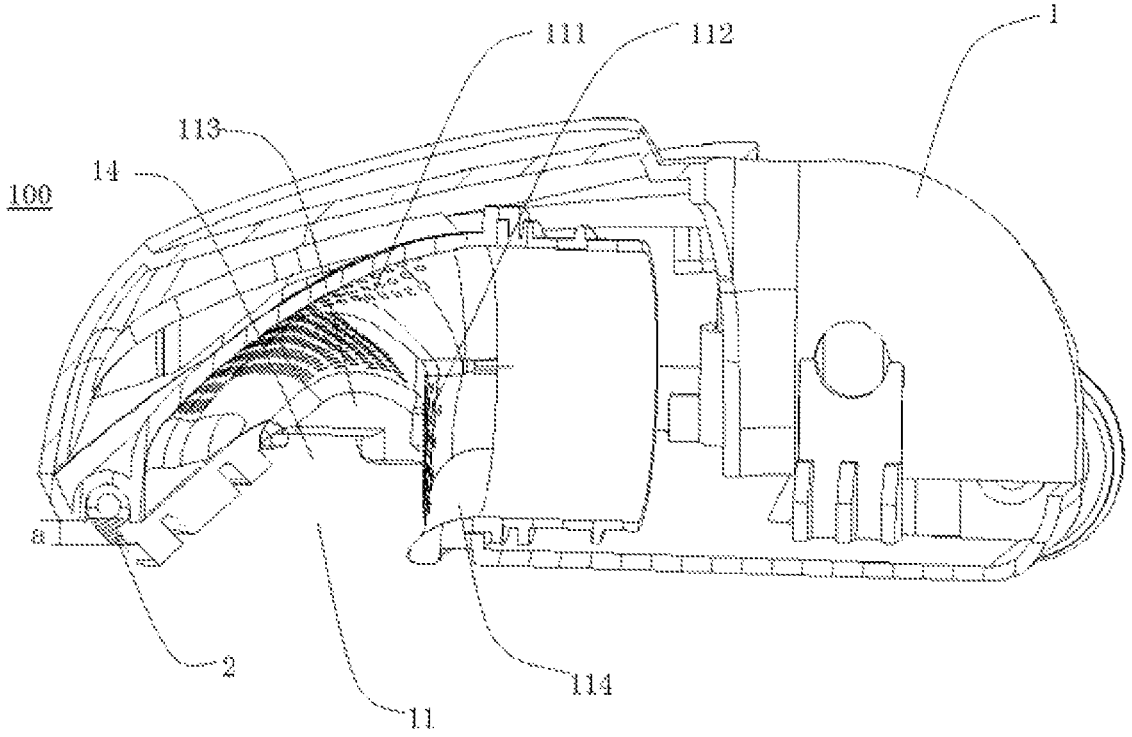
FIG. 4 is another partially sectional view of a ground brush for a cleaning appliance according to an embodiment of the present disclosure.

For example, with reference to FIG. 3 and FIG. 4, the front dust collection strip 2 is inclined towards the direction near to the center of the ground brush 100 for a cleaning appliance, relative to the normal direction of the surface to be cleaned. That is the front dust collection strip 2 can be obliquely mounted and towards an inner of the ground brush 100 for a cleaning appliance along a flowing direction of the air flow, i.e. the front dust collection strip 2 is obliquely mounted and towards the air channel 11. Therefore, the front dust collection strip 2 can guide the air flow entering the front air inlets 21, while compared with a traditional mounting manner, in which the front dust collection strip 2 is parallel to the normal of the surface to be cleaned, an angle between the front dust collection strip 2 and a top of the air channel 11 is reduced by obliquely mounting the front dust collection strip 2 relative to the normal of the surface to be cleaned. A vortex stagnation zone which is formed at the angle can be reduced, and the noise can be reduced, in which the vortex stagnation zone is formed because an area of the air flow sharply increases after entering the air channel.

In addition, because the front dust collection strip 2 is obliquely mounted relative to the normal direction of the surface to be cleaned, a portion of the air flow entering the ground brush 100 for a cleaning appliance through the front air inlets 21 obliquely and downwards impacts the surface to be cleaned, the object to be cleaned on the surface to be cleaned can be more easily rolled up. A direction of a velocity of a portion of the air flow reflected from the surface to be cleaned is oblique and upward, the portion of the air flow can enter the exhaust port 13 directly, which reduces impact to the air flow due to the air channel 11 and further reduces the noise. And on the premise that the front dust collection strip 2 has a consistent thickness, a contact area between the front dust collection strip 2 and the surface to be cleaned can be effectively increased because the front dust collection strip 2 is obliquely mounted relative to the normal direction of the surface to be cleaned. Therefore, during operation of the ground brush 100 for a cleaning appliance, airtightness between the air channel 11 and the surface to be cleaned is improved, and the dust cleaning ability of the ground brush 100 for a cleaning appliance is further improved.

In one embodiment, a longitudinal section of the front air inlets 21 may be rectangular, square, trapezoid and the like in shape, which is simple in structure and easy to manufacture.

For example, during operation of a cleaning appliance, the body 1 of the ground brush 100 for the cleaning appliance covers the surface to be cleaned, air flow enters the ground brush 100 for the cleaning appliance through the front air inlets 21, and dusts, hairs and the like object to be cleaned on the surface to be cleaned can be sucked into a duct cup of the cleaning appliance.

In one embodiment, the front dust collection strip 2 may be made from plastic or a strip made from plastic furs, but not limited thereto.

With the ground brush 100 for a cleaning appliance, the front dust collection strip 2 is obliquely mounted relative to the normal direction of the surface to be cleaned, the air channel 11 of the ground brush 100 for a cleaning appliance is optimized, the flowing condition of the air flow in the ground brush 100 for a cleaning appliance is improved, and the dust cleaning ability of the ground brush 100 for a cleaning appliance can be effectively improved and the noise from the ground brush 100 for a cleaning appliance can reduced. In addition, compared with a traditional noise reduction solution, in which a ground brush for a cleaning appliance is provided with a roller and a fan therein, or a body defines a noise reduction cavity filled with sound absorption medium, the ground brush 100 for a cleaning appliance is simple in structure and low in cost.

According to some embodiments of the present disclosure, an angle $\alpha$ between the front dust collection strip 2 and the normal direction of the surface to be cleaned satisfies that $\alpha$ is greater than or equal to 30° and less than or equal to 60°. A specific value can be adjusted and designed according to a specific specification and model of the ground brush 100 for a cleaning appliance. For example, $\alpha$ may satisfy that $\alpha$ is equal to 45°, 30° and 60°. Therefore, the front dust collection strip 2 can be conveniently assembled and the dust cleaning ability of the ground brush 100 for a cleaning appliance can be effectively improved, and the noise of the front dust collection strip 2 can be effectively reduced.

According to some embodiments of the present disclosure, a distance between an upper end of a front air inlet 21 and the bottom plate 12 satisfy that a is greater than or equal to 3 mm. A specific value can be adjusted and designed according to a specific specification and model of the ground brush 100 for a cleaning appliance. For example, a may further satisfy that a is equal to 3 mm, 5 mm and the like. Therefore, the distance between the upper end of the front air inlet 21 and the bottom plate 12 can be effectively controlled. The guiding effect of the front dust collection strip 2 can be ensured.

Furthermore, at least one side of the body 1 defines a side air inlet 14 in communication with the air channel 11. That is, the side air inlet 14 in communication with the air channel 11 can be defined in any one of a left side and right side of the body 1, or side air inlets 14 in communication with the air channel can be defined in both the left side and right side of the body 1. For example, with reference to FIG. 1 and FIG. 2, one side air inlet 14 is defined in each of the left side and right side of the body 1. Of course, it should be notated that, a plurality of side air inlets 14 may be defined in each left side and right side of the body 1. Therefore, air flow can enter the ground brush 100 for a cleaning appliance through the side air inlet 14. For convenience, in the following description, the air flow entering the ground brush 100 for a cleaning appliance through the front air inlets 21 is called "front air flow", and the air flow entering the ground brush 100 for a cleaning appliance through the side air inlet 14 is called "side air flow".

In one embodiment, a longitudinal section of the side air inlet 14 may be rectangular, square, trapezoid and the like in shape, but not limited thereto.

According to some embodiments of the present disclosure, the plurality of front air inlets 21 are symmetrically arranged about a central plane of symmetry of the body 1, and distances between adjacent front air inlets 21 are different. For example, distances between adjacent front air inlets 21 of the plurality of front air inlets 21 located in the same side of the central plane of symmetry are different. In one embodiment, the distances between adjacent front air inlets 21 gradually reduce towards a direction of the central plane of symmetry.

For example, in the example in FIG. 1, the distances between adjacent front air inlets 21 of the plurality of front air inlets 21 located in a right side of the central plane of symmetry gradually reduce towards a direction (for example, from the right to the left in FIG. 1) of the central plane of symmetry. Therefore, a flow area of the air flow entering through the side air inlet 14, i.e. the side air flow can be increased, the velocity of the side air flow can be reduced, such that the noise is reduced. As the closer to the central plane of symmetry, the larger of a cross sectional area of the air channel 11, an influence on the flow area of the air flow entering through the side air inlet 14, i.e. the side air flow caused by the air flow entering through the front air inlets 21, i.e. the front air flow can be effectively reduced, by reducing the distances between adjacent front air inlets 21 close to the central plane of symmetry, thereby reducing the noise caused by impact between two air flows.

For example, in the example shown in FIG. 1, six front air inlets 21 are defined in the front dust collection strip 2. Three front air inlets 21 are defined in the left side of the left side of the central plane of symmetry, other three front air inlets 21 are defined in the right side of central plane of symmetry, in which the former three front air inlets 21 and the latter three front air inlets 21 are symmetric relative to the central plane of symmetry. In one embodiment, for convenience, the three front air inlets 21 located in the right side of the central plane of symmetry are called a first front air inlet 21, a second front air inlet 21 and a third front air inlet 21, respectively. The first front air inlet 21 is closed to the central plane of symmetry, the third front air inlet 21 is away from the central plane of symmetry, and the second front air inlet 21 is between the first front air inlet 21 and the third front air inlet 21. A distance between the first front air inlet 21 and the second front air inlet 21 is denoted as d1, and a distance between the second front air inlet 21 and the third front air inlet 21 is denoted as d2, d1, and d2 satisfy that d1 is less than d2.

According to some embodiments of the present disclosure, a sum S1 of areas of the plurality of front air inlets 21 satisfies that S1 is greater than or equal to 200 mm2 and less than or equal to and less than or equal to 400 mm2. A specific value can be adjusted and designed according to a specific specification and model of the ground brush 100 for a cleaning appliance, which is not specifically limited herein. For example, S1 may further satisfy that S1 is equal to 200 mm2, 300 mm2 or 400 mm2 and the like. Therefore, the sum of the areas of the front air inlets 21 is moderate, on the premise of that the dust cleaning ability of the ground brush 100 for a cleaning appliance is ensured, the noise of the ground brush 100 for a cleaning appliance can be effectively reduced.

According to some embodiments of the present disclosure, a sum S2 of areas of the plurality of side air inlets 14 satisfies that S2 is greater than or equal to 100 mm2 and less than or equal to 300 mm2. A specific value can be adjusted and designed according to a specific specification and model of the ground brush 100 for a cleaning appliance, which is not specifically limited herein. For example, S2 may further satisfy that S2 is equal to 100 mm2, 200 mm2 or 300 mm2 and the like. Therefore, the sum of the areas of the side air inlets 14 is moderate, on the premise of that the dust cleaning ability of the ground brush 100 for a cleaning appliance is ensured, the noise of the ground brush 100 for a cleaning appliance can be effectively reduced.

According to some other embodiments of the present disclosure, the sum S1 of the areas of the plurality of front air inlets 21 and the sum S2 of areas of the side air inlets 14 satisfy 3 that a sum of S1 and S2 is greater than or equal to 300 mm2 and less than or equal to 500 mm2. Therefore, on the premise of that the dust cleaning ability of the ground brush 100 for a cleaning appliance is ensured, the noise of the ground brush 100 for a cleaning appliance can be also effectively reduced.

In one embodiment, a height of a side air inlet 14 is less than a height of a front air inlet 21, and a depth e of the side air inlet 14 satisfies that e is greater than or equal to 5 mm. A specific value can be adjusted and designed according to a specific specification and model of the ground brush 100 for a cleaning appliance, which is not specifically limited herein. For example, e may further satisfy that e is equal to 5 mm, 10 mm or 15 mm and the like. Therefore, the side air flow can exert a large tangential force on the surface to be cleaned, thereby improving the dust cleaning effect. The front air flow and the side air flow can be separated, thereby reducing impact between the two air flows, and further reducing the noise of the ground brush 100 for a cleaning appliance.

It should be noted herein, "the height of the side air inlet 14" means a distance between an upper end of the side air inlet 14 and the surface to be cleaned, and "the height of the front air inlet 21" means a distance between an upper end of the front air inlet 21 and the surface to be cleaned.

According to some embodiments of the present disclosure, with reference to FIG. 3 and combined with FIG. 4, the air channel 11 includes a front wall 111, a rear wall 112, two side walls 113 and a lower wall 114.

A distance between the front wall 111 and the surface to be cleaned gradually increases in a direction from the front to the rear and from two sides to the middle. The exhaust port 13 is defined in the front wall 111. Therefore, the flow area of the air flow can be increased, and the velocity of the air flow can be reduced, such that the noise can be effectively reduced. In one embodiment, the front wall 111 may have an arc surface, but it is not limited thereto.

A cross section of the rear wall 112 is an arc section, and a smooth transition is provided between an upper end of the rear wall 112 and the front wall 111, the exhaust port 13 is defined in the rear wall 112, and a smooth transition is provided between the exhaust port and the rear wall 112. Therefore, the side air flow can be made move near the rear wall 112, and then is discharged through the exhaust port 13 along the rear wall 112, flow resistance to the side air flow can be reduced, such that the noise of the ground brush 100 for a cleaning appliance is reduced.

The two side walls 113 are connected to two sides of the front wall 111 and the rear wall 112, respectively. The lower wall 114 is connected to the exhaust port 13. Therefore, during operation of the ground brush 100 for a cleaning appliance, an airtight space can be easily formed between the air channel 11 and the surface to be cleaned, such that the dust cleaning effect of the ground brush 100 for a cleaning appliance can be improved.

In one embodiment, the lower wall 114 has a curve surface. An angle β between a tangent at any point, which is projected by the lower wall 114, on the central plane of symmetry of the body 1 and the surface to be cleaned satisfies that β is less than or equal to 45°. A specific value can be adjusted and designed according to a specific specification and model of the ground brush 100 for a cleaning appliance, which is not specifically limited herein. For example, β may further satisfy that β is equal to 30°, 15° and the like. Therefore, a curvature of the lower wall 114 can be effectively controlled, an angle of inclination of the lower wall 114 can be reduced, impact on the lower wall 114 due to the air flow is reduced, and the noise of the ground brush 100 for a cleaning appliance can be further reduced.

In one embodiment, a height h of the side walls 113 satisfies that h is less than or equal to 3 mm. For example, h may further satisfy that h is equal to 2 mm and the like.

Therefore, expansion of the flow area of the air flow can be reduced, and the noise can be further reduced.

In one embodiment, a radius D of an arc surface of an arc transition between the rear wall 112 and the exhaust port 13 satisfies that D is greater than or equal to 25 mm. Therefore, the transition between the rear wall 112 and the exhaust port 13 is smooth, the flow resistance to the air flow can be effectively reduced, impact force due to the air flow can be reduced, and the noise of the ground brush 100 for a cleaning appliance can be further reduced.

According to some embodiments of the present disclosure, a cross section of the exhaust port 13 is in the shape of an ellipse. A long axis of the ellipse is parallel to the bottom plate 12, and a short axis of the ellipse is perpendicular to the bottom plate 12. Therefore, the radius of the arc surface of the transition between the rear wall 112 and the exhaust port 13 can be further increased, and the transition can be made smooth, which reduces separation of the side air flow due to turning when the side air flow enters the exhaust port 13. A large arc transition surface can be achieved, while a longitudinal length of the exhaust port 13 can be reduced. The angle of inclination of the lower wall 114 is made small, such that the front air flow can directly enter the exhaust port 13, impact on the lower wall 114 due to the front air flow can be further reduced, and the noise can be further reduced.

According to some other embodiments of the present disclosure, the cross section of the exhaust port 13 may be in the shape of a circle or a polygon with more than four edges. Therefore, the noise of the ground brush 100 for a cleaning appliance can also be reduced.

Furthermore, the body 1 is provided with the rear duct collection strip 3. With reference to FIG. 2, the rear duct collection strip 3 may be arranged at a front end of the bottom plate 12. The rear duct collection strip 3 may be a fur strip made from plastic fibers and used to seal. In one embodiment, when the ground brush 100 for a cleaning appliance covers the surface to be cleaned, the rear duct collection strip 3 can effectively improve airtight of the air channel 11, such that suction force of the ground brush 100 for a cleaning appliance is enhanced, and the duct cleaning ability of the ground brush 100 for a cleaning appliance is further improved.

For example, during operation of the cleaning appliance, air flows are sucked in through the front air inlets 21 and the side air inlets 14. The front air flow which enters through the front air inlets 21 enter the air channel 11, then the front air flow is discharged to the connecting tube, such as the hose, through the exhaust port 13, and then the front air flow enter a fan unit of the cleaning appliance. The side air flow enters through the side air inlets 14 enters the air channel 11, then the side air flow flows along the rear wall 112 of the air channel 11, and then the side flow is discharged to the connecting pipe through the exhaust port 13, and enters the fan unit. The object to be cleaned on the surface to be cleaned is sucked in a dust collector, such as a dust cup, along with the air flows.

A specific example of the ground brush 100 for a cleaning appliance according to embodiments of the present disclosure is described with reference to FIG. 1 to FIG. 4.

As shown in FIG. 1 and FIG. 2, the ground brush 100 for a cleaning appliance according to the embodiment of the present disclosure includes a body 1, a front dust collection strip 2 and a rear duct collection strip 3.

In one embodiment, the body 1 defines an air channel 11 therein, a bottom plate 12 of the body 1 defines a suction port in communication with the air channel 11, and a rear side of the body 1 defines an exhaust port 13. When the body 1 covers a surface to be cleaned, an airtight space is defined between the air channel 11 and the surface to be cleaned.

The front dust collection strip 2 is arranged at a front end of the body 1 to support the ground brush 100 for a cleaning appliance on the surface to be cleaned, and the front dust collection strip also separates the air channel 11 and the surface to be cleaned. The front dust collection strip 2 defines six front air inlets 21 in communication with the air channel 11, the front air inlets 21 have rectangular longitudinal sections. The front dust collection strip 2 is inclined, at an angle $\alpha$ ($\alpha$=45°), towards a direction near to a center of the ground brush 100 for a cleaning appliance, relative to a normal direction of the surface to be cleaned. Three front air inlets 21 at a left side of the central plane of symmetry of the body 1 and three front air inlets 21 at a right side of the central plane of symmetry of the body 1 are symmetrically arranged about the central plane of symmetry of the body 1, and distances between adjacent front air inlets 21 gradually reduce towards a direction of the central plane of symmetry. A distance a between an upper end of a front air inlet 21 and the bottom plate 12 satisfies that a is equal to 3 mm.

The exhaust port 13 is connected to a connecting tube (not shown), such as a hose, so as to deliver dust on the surface to be cleaned into a dust collection part, such as a dust cup, in a cleaning appliance.

Each left side and right side of the body 1 defines a longitudinal section side air inlet 14. A height of the side air inlet 14 is less than that of the front air inlet 21, and a depth e of the side air inlet 14 satisfies that e is equal to 8 mm.

A sum S1 of areas of the six front air inlets 21 satisfies that S1 is equal to 350 mm2, a sum S2 of areas of the two side air inlets 14 satisfies that S2 is equal to 150 mm2.

The air channel 11 includes a front wall 111, a rear wall 112, two side walls 113 and a lower wall 114. A distance between the front wall 111 and the surface to be cleaned gradually increases in a direction from the front the rear and from two sides to the middle. The front wall 111 has an arc surface. The exhaust port 13 is defined in the front wall 111. A cross section of the rear wall 112 is an arc section, and a smooth transition is provided between an upper end of the rear wall 112 and the front wall 111, the exhaust port 13 is defined in the rear wall 112, and a smooth transition is provided between the exhaust port and the rear wall 112. A radius D of an arc surface of an arc transition between the rear wall 112 and the exhaust port 13 satisfies that D is equal to 30 mm.

The two side walls 113 are connected to two sides of the front wall 111 and the rear wall 112, respectively. The lower wall 114 is connected to the exhaust port 13. The lower wall 114 has an arc surface. An angle $\beta$ between a tangent at any point, which is projected by the lower wall 114, on the central plane of symmetry of the body 1 and the surface to be cleaned satisfies that $\beta$ is equal to 40°. A height h of the side walls 113 satisfies that h is equal to 1.5 mm. A cross section of the exhaust port 13 is in the shape of an ellipse. A long axis of the ellipse is parallel to the bottom plate 12, and a short axis of the ellipse is perpendicular to the bottom plate 12.

The rear duct collection strip 3 is arranged at a front end of the bottom plate 12. The rear duct collection strip 3 is a fur strip made from plastic fibers, which can effectively improve the airtightness of the air channel 11. Therefore, suction force of the ground brush 100 for a cleaning appliance is enhanced, and the duct cleaning ability of the ground brush 100 for a cleaning appliance is further improved.

In order to verify the performance of noise reduction of the ground brush 100 for a cleaning appliance, a model is produced to be compared with a ground brush 100 for a cleaning appliance which presents general performance in the market at present, tests on noise and dust cleaning ability are carried out. The test on noise is carried out according to a procedure related to a household appliance or an appliance with a similar purpose under the reference standard IEC60704-1, and microphones are arranged at positions according to a semi-spherical surface arrangement with a radius r, r is equal to 1.5 m.

According to the test, the noise generated by the ground brush 100 for a cleaning appliance according to embodiments of the present disclosure greatly reduces at a low-frequency stage (<200 HZ) and a high-frequency stage (>800 HZ). The reason why the noise reduces at the low-frequency stage is that a large arc surface is provided at the smooth transition between the elliptic exhaust port 13 and the rear wall 112, separation between the air flow and the rear wall 112 is reduced during flowing, and a large vortex is reduced.

In addition, arrangement that the front dust collection strip 2 is inclined relative to the normal direction of the surface to be cleaned, and arrangement with the front air inlets 21 and the lower wall 114 reduce the noise due to impact. The reason why the noise reduces at the high-frequency stage is that the front dust collection strip 2 is inclined relative to the normal direction of the surface to be cleaned, a portion of the front air flow obliquely and upwards flows, and the portion of the front air flow is separated from the side air flow, as well as that distances of adjacent air inlets at the same side of the central plane of symmetry are different, influence on the side air flow due to the front air flow can be reduced, such that a small vortex generated by perturbation of the air flows is reduced.

A test method on dust cleaning ability is carried out under the reference standard IEC60312. After the test, dust cleaning ability, i.e. efficiency of dust cleaning of a reference ground brush 100 for a cleaning appliance is about 94.5%, while that of the ground brush 100 for a cleaning appliance of the embodiments of the present disclosure is about 96.5%, which means improvements. The reason is that the side air inlets 14 makes the air flow strongly impact the ground, in the meantime, the front dust collection strip 2 is inclined relative to the normal direction of the surface to be cleaned, which improves the airtight of the ground brush 100 for a cleaning appliance during movement and improve the efficiency of dust cleaning.

The tests show that, compared with the ground brush 100 for a cleaning appliance which presents general performance in the market at present, the noise is reduced by about 6 dB, the dust cleaning ability is improved by about two percent. Hence, the tests are repeated many times and show stable result.

According to the ground brush 100 for a cleaning appliance of the embodiments of the present disclosure, the air channel 11 of the ground brush 100 for a cleaning appliance is optimized, flowing conditions of the air flows in the ground brush 100 for a cleaning appliance is improved, the dust cleaning ability of the ground brush 100 for a cleaning appliance is effectively improved and the noise of the ground brush 100 for a cleaning appliance is reduced, and the ground brush is simple in structure and low in cost.

A cleaning appliance according to an embodiment of the present disclosure includes an appliance body and the ground brush 100 for a cleaning appliance according to an embodiment of the present disclosure. The ground brush 100 for a cleaning appliance is in communication with the appliance body by means of a connecting tube, such as a hose. The cleaning appliance may be an upright cleaning appliance or a canister cleaning appliance or the like.

The cleaning appliance according to the embodiment of the present disclosure includes the ground brush 100 for a cleaning appliance according to the embodiment of the present disclosure, the dust cleaning ability of the cleaning appliance is improved, and the noise of the cleaning appliance is reduced, the structure of the cleaning appliance is simplified and the cost of the cleaning appliance is lowered.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. Thus, the appearances of the phrases are not necessarily referring to the same embodiment or example of the present disclosure. Furthermore, the particular features, structures, materials, or characteristics may be combined in any suitable manner in one or more embodiments or examples.

What is claimed is:

1. A ground brush for a cleaning appliance, comprising:

a body defining an air channel therein, the body comprising a bottom plate defining a suction port in communication with the air channel and a rear side defining an exhaust port, wherein when the body covers a surface to be cleaned, a closed space is defined between the air channel and the surface to be cleaned; and a front dust collection strip fixedly arranged at a front end of the body to support the ground brush for a cleaning appliance on the surface to be cleaned, defining a plurality of front air inlets in communication with the air channel, and being inclined inwards relative to the surface to be cleaned;

wherein the distances between adjacent front air inlets gradually reduce towards a central plane of symmetry of the body.

2. The ground brush according to claim 1, wherein an angle $\alpha$ between the front dust collection strip and a perpendicular direction of the surface to be cleaned satisfies that a is greater than or equal to 30° and less than or equal to 60°.

3. The ground brush according to claim 2, wherein the angle $\alpha$ between the front dust collection strip and the perpendicular direction of the surface to be cleaned satisfies that $\alpha$ is equal to 45°.

4. The ground brush according to claim 1, wherein distance "a" between an upper end of a front air inlet and the bottom plate satisfies that "a" is greater than or equal to 3 mm.

5. The ground brush according to claim 1, wherein the plurality of front air inlets are symmetrically arranged about the central plane of symmetry of the body.

6. The ground brush according to claim 1, wherein a sum S1 of areas of the plurality of front air inlets satisfies that S1 is greater than or equal to 200 mm2 and less than or equal to and less than or equal to 400 mm2.

7. The ground brush according to claim 1, wherein at least one side of the body defines a side air inlet in communication with the air channel.

8. The ground brush according to claim 7, wherein a height of the side air inlet is less than a height of a front air inlet, and a depth d of the side air inlet satisfies that d is greater than or equal to 5 mm.

9. The ground brush according to claim 7, wherein a sum S2 of area of the side air inlet satisfies that S2 is greater than or equal to 100 mm2 and less than or equal to 300 mm2.

10. The ground brush according to claim 9, wherein a sum S1 of areas of the plurality of front air inlets and the sum S2 of the area of the side air inlet satisfy that a sum of S1 and S2 is greater than or equal to 300 mm2 and less than or equal to 500 mm2.

11. The ground brush according to claim 1, wherein the air channel comprises:

a front wall, a distance between the front wall and the surface to be cleaned gradually increasing in a direction from front to rear and from two sides to middle, the exhaust port being defined in the front wall;

a rear wall, a cross section of the rear wall being an arc section, a smooth transition being provided between an upper end of the rear wall and the front wall, the exhaust port being defined in the rear wall, and a smooth transition being provided between the exhaust port and the rear wall;

two side walls connected to two sides of the front wall and the rear wall, respectively; and a lower wall connected to the exhaust port, having an arc surface, and an angle β between a tangent at any point, which is projected by the lower wall, on the central plane of symmetry of the body and the surface to be cleaned satisfies that β is less than or equal to 45°.

12. The ground brush according to claim 11, wherein a height h of the side walls is less than or equal to 3 mm.

13. The ground brush according to claim 11, wherein a radius D of an arc surface of an arc transition between the rear wall and the exhaust port satisfies that D is greater than or equal to 25 mm.

14. The ground brush according to claim 1, wherein a cross section of the exhaust port is in the shape of an ellipse, a long axis of the ellipse is parallel to the bottom plate, and a short axis of the ellipse is perpendicular to the bottom plate.

15. The ground brush according to claim 1, wherein a cross section of the exhaust port is in the shape of a circle or a polygon with more than four edges.

16. A cleaning appliance, comprising:

an appliance body; and a ground brush for a cleaning appliance, comprising:

a body defining an air channel therein, the body comprising a bottom plate defining a suction port in communication with the air channel and a rear side defining an exhaust port, wherein when the body covers a surface to be cleaned, a closed space is defined between the air channel and the surface to be cleaned; and a front dust collection strip fixedly arranged at a front end of the body to support the ground brush for a cleaning appliance on the surface to be cleaned, defining a plurality of front air inlets in communication with the air channel, and being inclined inwards relative to the surface to be cleaned;

wherein the ground brush being in communication with the appliance body through a connecting tube;

wherein the distances between adjacent front air inlets gradually reduce towards a central plane of symmetry of the body.

17. The ground brush according to claim 1, wherein a rear duct collection strip is provided on the bottom plate opposite to the front dust collection strip relative to the suction port.

* * * * *